US012655847B2

(12) United States Patent
Schunk et al.

(10) Patent No.: US 12,655,847 B2
(45) Date of Patent: Jun. 16, 2026

(54) PUMP WITH AN HM INTERFACE WHICH CAN BE INSTALLED IN A VARIABLE MANNER

(71) Applicant: KSB SE & Co. KGaA, Frankenthal (DE)

(72) Inventors: Axel Schunk, Frankenthal (DE); Tobias Seckinger, Frankenthal (DE)

(73) Assignee: KSB SE & Co. KGaA, Frankenthal (DE)

( * ) Notice: Subject to any disclaimer, the term of this patent is extended or adjusted under 35 U.S.C. 154(b) by 2 days.

(21) Appl. No.: 18/727,858

(22) PCT Filed: Dec. 15, 2022

(86) PCT No.: PCT/EP2022/086123
§ 371 (c)(1),
(2) Date: Jul. 10, 2024

(87) PCT Pub. No.: WO2023/134954
PCT Pub. Date: Jul. 20, 2023

(65) Prior Publication Data
US 2025/0092875 A1 Mar. 20, 2025

(30) Foreign Application Priority Data
Jan. 11, 2022 (DE) ..... 10 2022 100 484.8

(51) Int. Cl.
*F04D 13/06* (2006.01)
*F04D 1/00* (2006.01)
*F04D 29/42* (2006.01)

(52) U.S. Cl.
CPC ..... *F04D 13/0686* (2013.01); *F04D 1/00* (2013.01); *F04D 29/42* (2013.01)

(58) Field of Classification Search
CPC ..... F04D 13/0686; F04D 1/00; F04D 29/42; F05D 2260/30
See application file for complete search history.

(56) References Cited

U.S. PATENT DOCUMENTS

2011/0280744 A1* 11/2011 Ortiz ..... F04D 25/068 417/313
2012/0308401 A1* 12/2012 Knedler ..... F04D 25/06 417/1

(Continued)

FOREIGN PATENT DOCUMENTS

EP 0 819 851 A2 1/1998
WO WO 2010/009704 A2 1/2010

(Continued)

OTHER PUBLICATIONS

International Search Report (PCT/ISA/210) issued in PCT Application No. PCT/EP2022/086123 dated Mar. 31, 2023 with English translation (7 pages).

(Continued)

*Primary Examiner* — Thomas Fink
(74) *Attorney, Agent, or Firm* — Crowell & Moring LLP

(57) ABSTRACT

A centrifugal pump includes at least one electric pump drive, at least one electric pump drive, and at least one operating part. The at least one operating part that is operable by a user. The at least one operating part is fixed on a housing part of the pump and is fastened to the housing part in at least two different fixing positions. The operating part is connected to the housing part via a rotary guide in order to rotate the operating part between the at least two fixing positions.

14 Claims, 5 Drawing Sheets

(56) References Cited

U.S. PATENT DOCUMENTS

| | | | | |
|---|---|---|---|---|
| 2015/0002002 | A1* | 1/2015 | Monster | H02K 11/30 310/68 R |
| 2017/0014302 | A1 | 1/2017 | Liu | |
| 2019/0203706 | A1* | 7/2019 | Matsumoto | F04B 53/16 |
| 2021/0006128 | A1* | 1/2021 | Eason | H02K 11/33 |
| 2022/0269353 | A1* | 8/2022 | Bolane | F04D 1/00 |
| 2023/0008400 | A1* | 1/2023 | Miedema | F04D 29/601 |
| 2023/0137224 | A1* | 5/2023 | Miller | F04D 1/00 417/44.1 |

FOREIGN PATENT DOCUMENTS

| | | | | |
|---|---|---|---|---|
| WO | WO 2011/106530 | A1 | 9/2011 | |
| WO | WO-2016086986 | A1 * | 6/2016 | F04D 13/0686 |

OTHER PUBLICATIONS

German-language Written Opinion (PCT/ISA/237) issued in PCT Application No. PCT/EP2022/086123 dated Mar. 31, 2023 with English translation (8 pages).

German-language Search Report issued in German Application No. 10 2022 100 484.8 dated Nov. 11, 2022 with partial English translation (13 pages).

* cited by examiner

PUMP WITH AN HM INTERFACE WHICH CAN BE INSTALLED IN A VARIABLE MANNER

CROSS REFERENCE TO RELATED APPLICATION

This application claims priority under 35 U.S.C. § 119 from German Patent Application No. 102022100484.8, filed Jan. 11, 2022, the entire disclosure of which is herein expressly incorporated by reference.

BACKGROUND

The disclosure relates to a pump, in particular a centrifugal pump, comprising at least one electric pump drive, at least one electronics housing, and at least one operating part for user interaction, wherein the at least one operating part is fixed on a housing part of the pump and can be fastened to the housing part in at least two different fixing positions.

Modern pumps, in particular circulation pumps for heating systems, have a compact design. The necessary electronics for the integral control unit of the pump are often situated in an electronics housing attached to the circumference of the pump housing or motor housing. For interaction with the pump, an operator control panel is provided, which not only displays information about the operation of the pump to the user by means of a display, but also allows the pump to be configured or controlled via individual input elements. Such an operator control panel can be integrated directly in the electronics housing or the pump housing or motor housing or instead be installed as a separate device on the housing.

The way in which pumps are set up depends, inter alia, on the design and is generally selected on the basis of the application and the surroundings. A pump setup with a horizontally or vertically oriented impeller axis or motor axis is known. Certain pumps permit a flexible setup, which must be taken into account when integrating the operator control panel, otherwise the legibility of the display and the use of the operating elements are impaired.

To solve this problem, WO 2011/106530 A1 already proposes a detachable operating part for pumps, which can be mounted in different orientations on the pump depending on the installation position of the pump. For rearrangement, the operating part must be detached completely from the pump housing, and the electrical connection between the operating part and the pump electronics by means of a plug connection must be disconnected. A disadvantage of this solution consists in the complex design of the electrical plug connection. Furthermore, the disconnection and reconnection of the electrical connection always means a certain risk for the person doing this, but also for the connection itself, since incorrect handling, in particular by untrained personnel, can result in damage to the electrical contact.

There is therefore a desire for an improved solution which permits a simpler and safer change of the position of the operating part relative to the pump housing.

This object is achieved by a pump according to the features of this specification. Advantageous embodiments of the pump also form the subject matter of this specification.

According to the disclosure, it is proposed to connect the operating part to the housing part of the pump via a rotary guide, in particular in a non-detachable manner. Unlike the prior art, a complete separation of the operating part from the pump housing, in particular an electrical disconnection, during the relocation of the operating part is not provided.

The mechanical connection remains intact via the rotary guide, and the operating part can be rotated about the rotational axis of the rotary guide relative to the housing part into the desired fixing position.

This has the advantage that an electrical connection between the two components does not have to be disconnected but can be retained. Overall, a not only faster but also safer process for relocating the operating part is made possible as a result. Furthermore, any strain relief means for the cable connection, which prevent unintentional detachment of the electrical connection, can be omitted.

The use of the disclosure is expedient in particular with pumps which technically allow a flexible setup of the pump assembly, for example a flexible installation with a horizontal or vertical impeller axis or motor axis. Depending on the setup type, the rotary guide can then be used to adapt the orientation of the operating part to the setup type before or after completed installation of the pump. In this case, it is expedient for the operating part to be able to rotate relative to the housing by at least 90°. However, the permissible rotary angle can be extended beyond this, for example a rotation of the operating part relative to the housing part of at least 180° or even more can be possible.

The rotary guide is expediently used at the same time as a cable bushing for the electrical connection between the operating part and the pump electronics. The integral cable bushing allows the use of conventional and commercially available electrical cables for the signaling and/or energy supply cables. Additional components such as plug connections are not needed, at least in the region of the rotary guide. The cable routing between the two components can be realized by at least one continuous cable which cannot be disconnected. However, this does not exclude plug connectors being provided on the cables themselves, for example for the purposes of contact with a printed circuit board inside the housing part and/or operating part or any devices. However, these plug connectors do not have to be accessible during the rearrangement of the operating part.

The rotary guide itself can be designed in various ways. For instance, the use of any desired hinge joint is conceivable. A snap connection is proposed as a simple and preferred design. For this purpose, one or more snap hooks are formed on the operating part or alternatively on the housing part, which snap hooks extend, in particular perpendicularly, from the mounting face of the operating part or of the housing part. Mounting face means the faces of the operating part and of the housing part which contact one another.

The snap hooks engage in a corresponding snap opening in the opposite mounting face of the housing part, or of the operating part in the alternative solution, and latch there at the opening edge. The spacing of the at least two snap hooks depends on the width or the diameter of the snap opening so that the two snap hooks protrude into the snap opening and their barbs can engage behind the opening edge. This results in a latching of the barbs at the opening edge, as a result of which disconnection of the rotary connection is impossible or at least is possible only with an increased application of force and at the same time deformation of the snap hooks. When the operating part is rotated, the snap hooks are guided along the opening edge of the snap opening. Ideally, the sliding face of the snap hooks is adapted to the contour of the snap opening wall.

Expediently, the one or more snap hooks are arranged at the edge of an opening in the mounting face of the operating part or alternatively of the housing part. This opening is used together with the snap opening of the corresponding part as a cable bushing between the two components.

The use of multiple snap hooks, in particular two snap hooks, which are arranged at opposing points of the opening edge is conceivable, for example. The two or more snap hooks should ideally be uniformly distributed around the opening edge, which optimizes the rotary guide and stability of the connection. For example, three snap hooks can be arranged offset by 120° around the opening edge.

In addition to the one or more snap hooks, one or more guiding elements can also be formed around the opening. The contour of the additional guiding elements, in particular at least the sliding face thereof, is preferably adapted to the contour of the inner wall of the snap opening, so that these slide along the inner edge of the snap opening and ensure additional stability during rotation. A design with two opposing snap hooks and two opposing guiding elements is conceivable, for example.

At least one rotation limit can also be provided to limit the maximum rotary angle of the operating part relative to the pump. This is expedient in particular when the rotary connection is additionally used as a cable bushing and over-rotation could result in damage to the cable fed through. For example, the rotary angle can be limited to less than 360°, preferably to approximately 270°, ideally to approximately 180°, by means of the rotation limiter. A limit to a rotary angle of less than 180°, for example to at most 90°, is also conceivable.

The rotation limit can comprise a pin protruding from the operating part or alternatively from the housing part or the mounting face in question. The pin protruding perpendicularly from the corresponding mounting face projects into a contour, in particular guide groove, formed on the opposite mounting face of the operating part or housing part. The pin slides along this counter contour during the rotary movement. The counter contour is a part-circle-shaped guide groove, for example. The ends of the guide groove or counter contour act as stops for the pin and thus limit the rotary angle in at least one, preferably both directions of rotation.

Since the rotary connection and the corresponding cable bushing means that openings are provided both in the pump housing and in the operating part housing, the interface between the two components must be sufficiently protected from spray. Against this background, it is expedient to arrange at least one seal element in the region around the rotary guide, which seal element in particular completely surrounds the rotary guide. The arrangement of the seal element can be provided either directly on the mounting face of the operating part or alternatively on the mounting face of the housing part. Ideally, the seal element is a ring seal which is arranged coaxially around the rotary guide on one of the mounting faces, for example let into a dedicated groove provided there.

Preferably, the rotary guide permits a certain axial play, i.e., a play along the rotational axis, between the two components to allow a virtually frictionless rotary movement or a rotary movement without contact between the mounting faces. However, the axial play can also be limited so that the contact force of the mounting faces can be reduced temporarily for the rotary movement but the mounting faces remain in contact. In this case, it is expedient when the seal element used comprises a slidable seal material.

As already indicated above, a certain contact force should act on the operating part or housing part in the axial direction in each fixing position in order firstly to prevent the rotary movement and secondly to effect sufficient compression of the seal element to seal the interface. This is achieved for example by an anti-rotation means to fix the operating element in a rotationally fixed manner in the desired position on the housing part. Expediently, the necessary axial force is also applied by the anti-rotation means. The use of one or more screw connections between the operating part and housing part, which are set perpendicularly to the mounting faces, is conceivable.

Preferably, the operating part has multiple receptacles for screws, and the housing part has multiple bores for screw-fastening, as a result of which the operating part can be screw-fastened in at least two different fixing positions. Expediently, the operating part is fixed via at least two screw connections in each fixing position. The receptacles in the operating part expediently allow access to the screw heads from the operating side.

The housing part for receiving the operating part is preferably the electronics housing of the pump. Such an electronics housing generally comprises a frequency converter for controlling the speed of the pump and is also referred to as a converter housing in practice. The electronics housing can be installed on the circumference of the motor housing and/or pump housing.

The operating part can have one or more input elements for configuring and/or controlling the pump. Alternatively or additionally, the operating element can comprise at least one display element in order to display different operating parameters of the pump visually to the user. The input elements can be in the form of buttons, switches, touch-sensitive input elements or a combination of these. At least one input element can be a mechanical adjusting wheel or an adjusting wheel simulated by means of a touch-sensitive surface.

Further advantages and properties of the disclosure shall be explained in more detail below using an exemplary embodiment shown in the figures. In the figures:

DETAILED DESCRIPTION

Figure 1B:
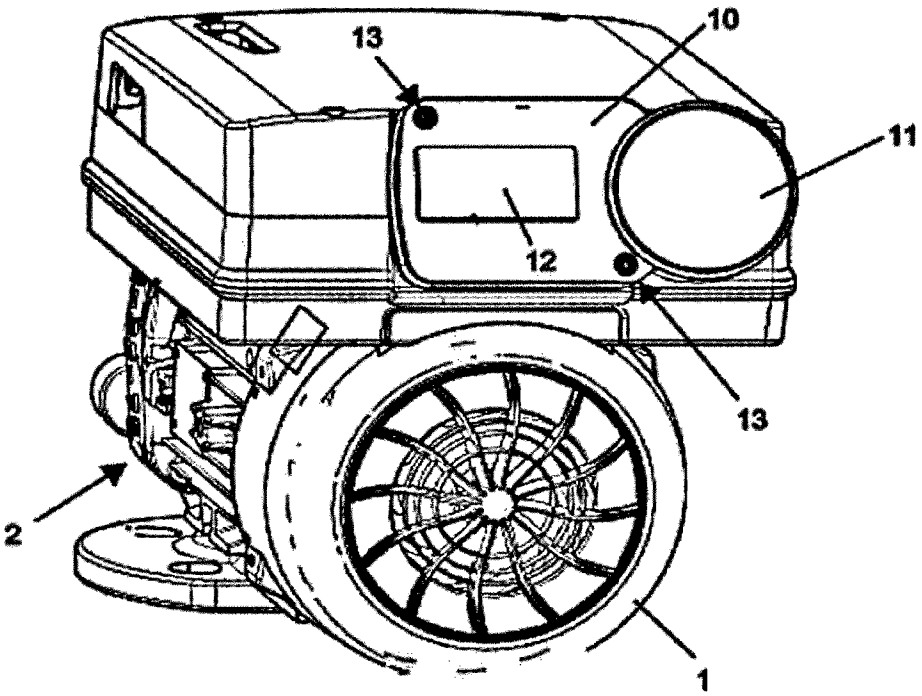
FIGS. 1*a* to 1*c*: show different views of the pump according to the disclosure.
Figure 1A:
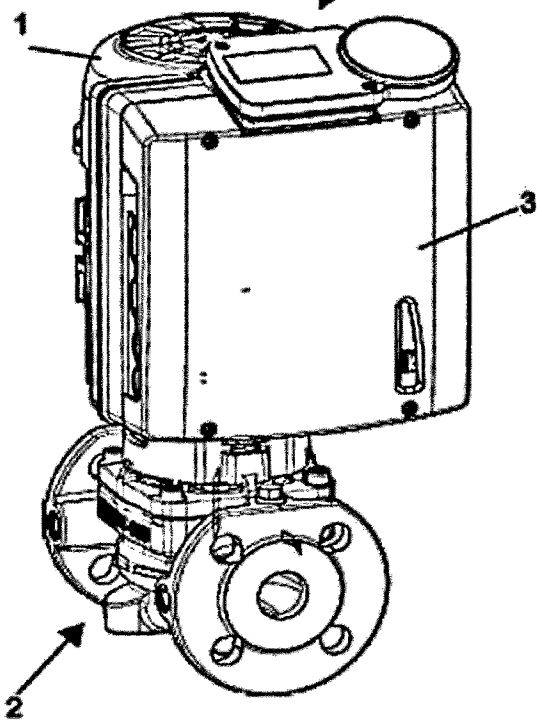
Figure 1C:
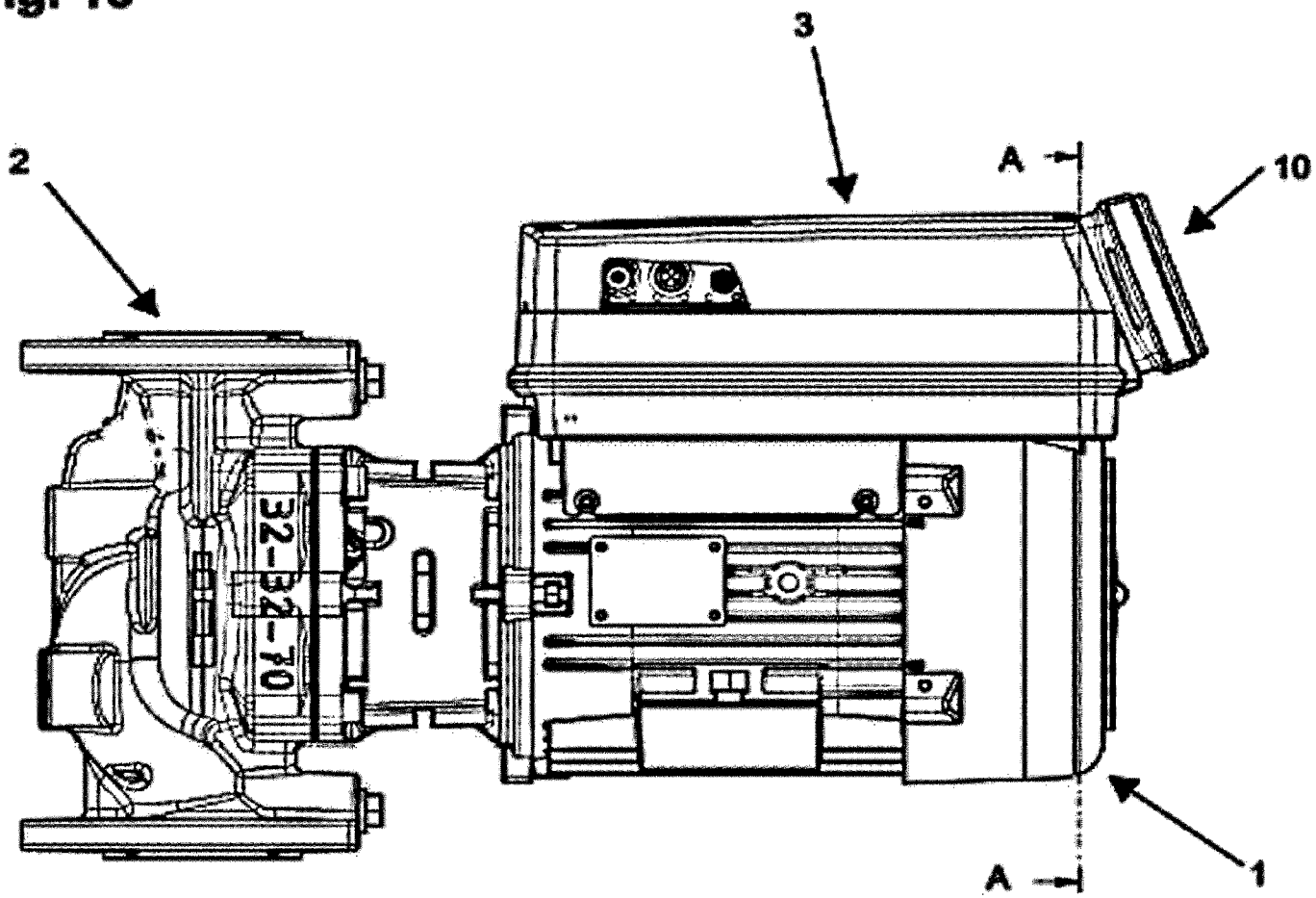

FIGS. 1*a* to 1*c* show different views of the pump according to the disclosure. The pump consists of a hydraulic pump part 2, which is designed by way of example as a centrifugal pump in the exemplary embodiment. An electric motor 1 attached directly to the hydraulic housing is used to drive the integral impeller. On the circumference of the motor housing there is a converter housing 3, which can contain central control logics of the pump, in addition to the necessary converter electronics.

The converter housing 3, which is substantially polygonal here, has an operating part 10 on a narrow side face, which operating part has a visual display 12 for displaying relevant pump data and at least one operating element 11. Via the operating element 11, which is designed as an adjusting wheel here, the user can configure the pump control or else make control inputs for manual control of the pump.

FIG. 1*a* shows the pump in a vertical setup, i.e., the rotational axis of the pump impeller and of the motor run vertically. FIG. 1*b* shows the identical pump in a horizontal setup. To optimize access to the operating part 10 independently of the setup type, the operating part in the horizontal installation position according to FIG. 1*b* is mounted rotated by 180° relative to the converter housing 3 in comparison with the vertical installation position according to FIG. 1*a*. The change in the fixing position of the operating part 10 on the converter housing 3 is realized by means of the rotary guide 20 according to the disclosure between the operating part 10 and the electronics housing 3, which rotary guide ensures a comparatively simple, fast and safe relocation.

The operating part 10 is fixed to the converter housing 3 inter alia via the two screws 13, which are accessible from the operating surface of the operating part 10 and extend through the operating part into the converter housing 3. The resulting screw connection means not only that an anti-rotation means is achieved but also that the operating part 10 is pressed against the converter housing 3 with the necessary axial force. When the screws 13 are loosened, the axial force is no longer applied, and a certain axial play of the rotary guide 20 permits a virtually force-free rotation of the operating part 10 relative to the converter housing 3.

Figure 2:
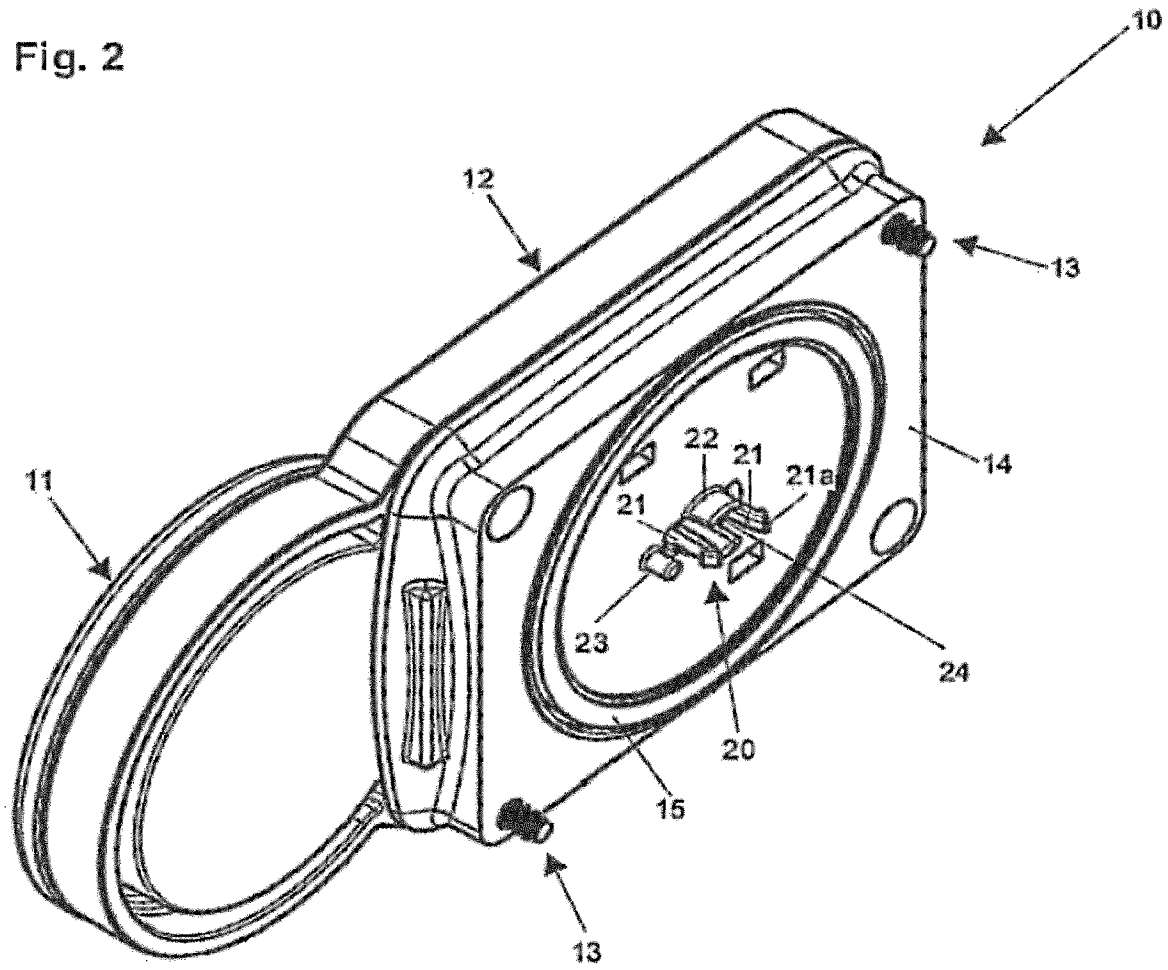
FIG. 2 shows a rear view of the operating part for the pump according to the disclosure.

The essential thing with the rotary guide 20 between the operating part 10 and the converter housing 3 is that the mechanical connection between the two components 3, 10 remains intact. The design of the rotary guide 20 necessary for this shall be explained below using FIG. 2, which shows a rear view of the operating part 10. The face of the operating part 10 facing the converter housing 3 in the mounted position is referred to as the mounting face 14. This mounting face 14 comprises a central, circular opening 24, through which at least one electrical cable runs outward from the interior of the operating part 10. Around the edge of the opening 24, two mutually opposing snap hooks 21 are provided, which protrude perpendicularly from the mounting face 14 in the direction of the converter housing 3 and have barbs 21*a* at the free end. Between the two snap hooks 21, two mutually opposing guiding elements 22 are formed, which likewise protrude perpendicularly from the mounting face 14, and the outer contour of which is adapted to the inner contour of the corresponding snap opening 32 in the converter housing 3 (see FIG. 3).

Figure 3:
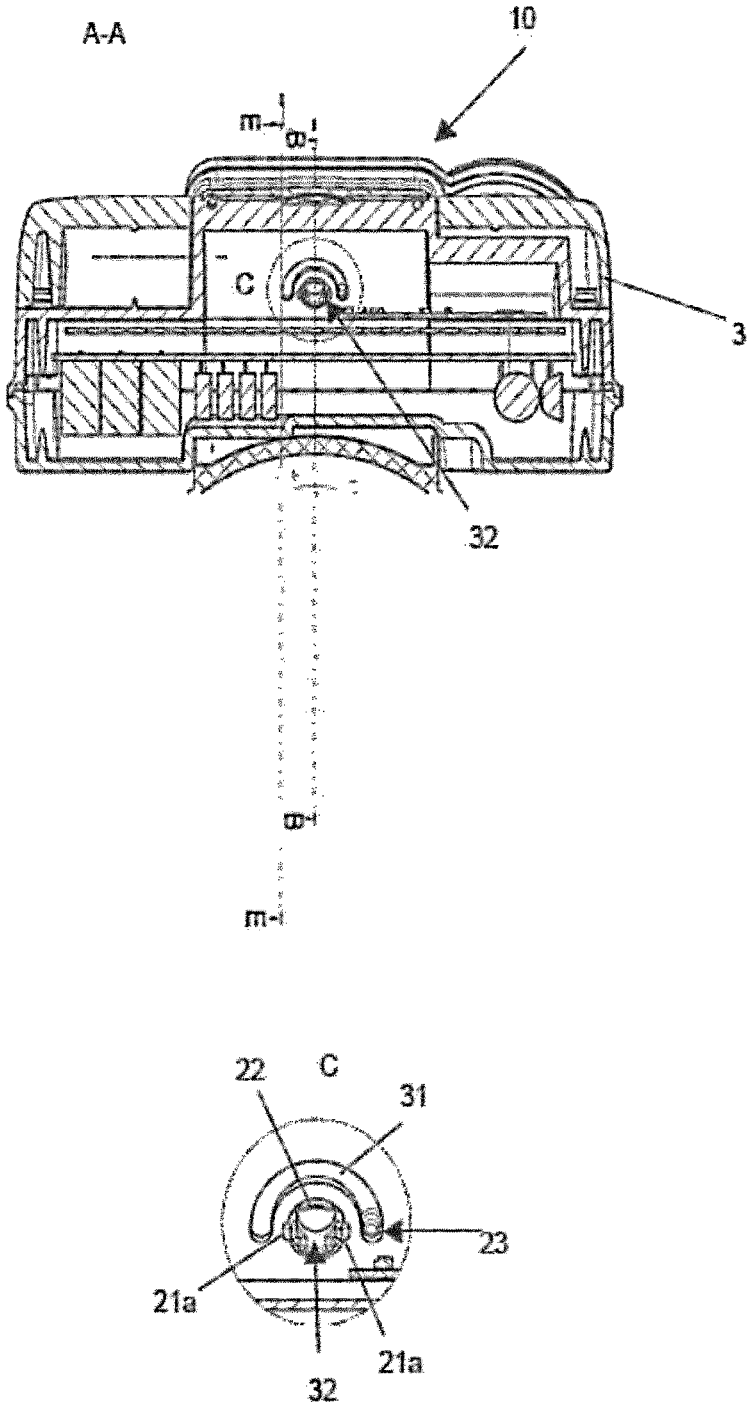
FIG. 3 shows a sectional view of the pump according to FIGS. 1*a* to 1*c* in the region of the interface A-A between the operating part and the electronics housing.

The pin 23 formed slightly offset from the left-hand snap hook 21 is part of a rotary angle limit and runs in a corresponding guide groove 31 in the converter housing 3 during the rotary movement (see FIG. 3). The thread ends of the screws 13 fed through can also be seen. An elastic ring seal 15, which is let into an annular groove in the mounting face 14, runs coaxially around the opening 24.

FIG. 3 shows a sectional diagram of the pump along the section axis A-A of FIG. 1*c*. The enlarged detail diagram C of FIG. 3 shows the snap opening 32 from a perspective from the interior of the converter housing 3. The two barbs 21*a* of the snap hooks 21 can be seen, which run through the snap opening 32 in the converter housing 3 and engage behind the inner edge of the snap opening 32 for latching. A stable rotary connection which cannot be disconnected is thereby created between the operating part 10 and the electronics housing 3. Also visible are the two guiding elements 22, the outer contours of which bear against and slide along the inner wall of the snap opening 32. The electrical connection cables run through the overlapping openings 24, 32 between the operating part 10 and the electronics in the converter housing 3.

The guide groove 31 for the rotary angle limit runs coaxially around the snap opening 32 in the form of half an annular groove. The two ends of the half an annular groove 31 form stop faces for the engaging pin 23 for rotary angle limitation in both directions. The semicircular annular groove 31 ensures a rotary angle of at most 180°.

Figure 4B:
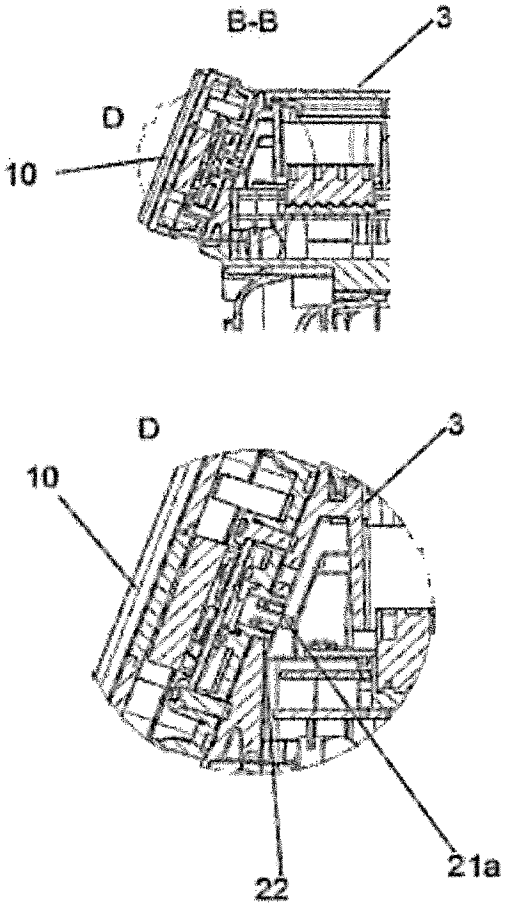
FIGS. 4*a* and 4*b* show different sectional diagrams along the section axes B-B and E-E according to FIG. 3.
Figure 4A:
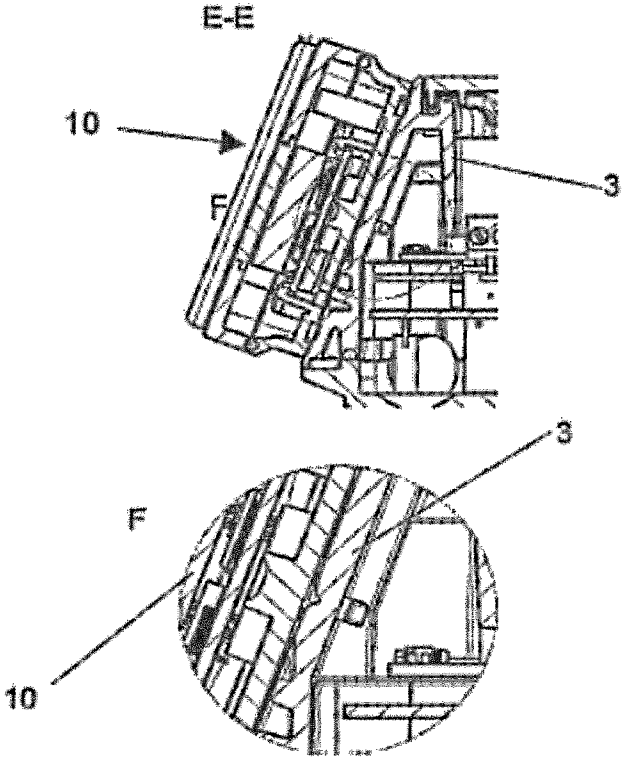

FIGS. 4*a*, 4*b* again show sectional diagrams along the section axes E-E and B-B of FIG. 3.

As already described above, the two screws 13 must first be loosened in order to rotate the operating part 10 relative to the converter housing 3. As a result of the loosening of the screw connection, the contact force of the operating part 10 on the electronics housing 3 in the axial direction decreases so that in the ideal case a frictionless rotation is made possible. As long as a limited axial play does not allow the mounting face 14 of the operating part 10 to lift off fully from the mounting face of the converter housing 3, the ring seal 15 should be composed of a suitable material with sufficient slidability.

The foregoing disclosure has been set forth merely to illustrate the disclosure and is not intended to be limiting. Since modifications of the disclosed embodiments incorporating the spirit and substance of the disclosure may occur to persons skilled in the art, the disclosure should be construed to include everything within the scope of the appended claims and equivalents thereof.

The invention claimed is:

1. A centrifugal pump, comprising:

at least one electric pump drive;

at least one electronics housing; and at least one operating part that is operable by a user, wherein the at least one operating part is fixed on a housing part of the pump and is fastened to the housing part in at least two different fixing positions, and the operating part is connected to the housing part via a rotary guide in order to rotate the operating part between the at least two fixing positions, wherein the rotary guide is configured as a snap connection, and wherein one or more snap hooks protrude from the mounting face of the operating part or of the housing part and project into a corresponding snap opening in a corresponding mounting face of the housing part or operating part and latch there.

2. The centrifugal pump as claimed in claim 1, wherein the rotary guide is configured to: i) allow a rotation of the operating part relative to the housing part, and ii) prevent a complete removal of the operating part from the housing part.

3. The centrifugal pump as claimed in claim 2, wherein the coaxially pump is configured with horizontal and vertical motor axis or impeller axis, and a position of the operating part is adapted to the setup type via the rotary guide, and the operating part is rotatable by at least 90 degrees between at least two fixing positions.

4. The centrifugal pump as claimed in claim 3, wherein the rotary guide comprises a cable bushing, and at least one electrical connection cable runs between the housing part and the operating part in a region of the rotary guide.

5. The centrifugal pump as claimed in claim 4, further comprising: one or more snap hooks that are arranged on an edge of an opening in the mounting face of the operating part or housing part, wherein the opening together with the snap opening forms the cable bushing between the housing part and the operating part.

6. The centrifugal pump as claimed in claim 4, further comprising: at least two snap hooks, which are arranged in opposing positions on the opening edge and/or uniformly distributed around the opening on the opening edge.

7. The centrifugal pump as claimed in claim 6, further comprising: one or more guiding elements that are formed around the opening, wherein the guiding elements protrude into the snap opening and slide along the wall of the snap opening during the rotary movement.

8. The centrifugal pump as claimed in claim 7, further comprising: at least one rotary angle limit that is provided in order to limit the relative rotary angle of the operating part relative to the housing part.

9. The centrifugal pump as claimed in claim 8, wherein the rotary angle limit is formed by a pin which protrudes from the operating part or housing part and is guided inside a guide groove, in the housing part or operating part during the rotary movement.

10. The centrifugal pump as claimed in claim 9, wherein the rotary guide allows an axial play in order to change the spacing between the operating part and the housing part.

11. The centrifugal pump as claimed in claim 10, further comprising: a seal ring, which runs around coaxially with the rotary guide, wherein the seal element is fixed on a mounting face of the operating part or housing part, and the seal element is manufactured from a slidable seal material.

12. The centrifugal pump as claimed in claim 11, wherein at least one anti-rotation means is provided to fix the operating part in a rotationally fixed manner in a desired position on the housing part, and the anti-rotation means is a detachable screw connection between the operating part and the housing part.

13. The centrifugal pump as claimed in claim 12, wherein the housing part is a frequency converter housing, which is mounted on a circumference of the motor housing and/or pump housing.

14. The centrifugal pump as claimed in claim 13, wherein the operating part comprises at least one input element and/or at least one display element.

* * * * *